US006250962B1

(12) United States Patent
Shinozaki

(10) Patent No.: US 6,250,962 B1
(45) Date of Patent: Jun. 26, 2001

(54) SEALING PLUG FOR A WATERTIGHT CONNECTOR AND A WATERTIGHT CONNECTOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/484,711

(22) Filed: Jan. 18, 2000

(30) Foreign Application Priority Data

Jan. 29, 1999 (JP) ..... 11-022155
Feb. 17, 1999 (JP) ..... 11-038120

(51) Int. Cl.[7] ..... H01R 13/40

(52) U.S. Cl. ..... 439/587; 439/275

(58) Field of Search ..... 439/274, 275, 439/587, 289

(56) References Cited

U.S. PATENT DOCUMENTS 4,179,319 12/1979 Lofdahl .
5,569,051 * 10/1996 Endo et al. ..... 439/587
5,588,856 12/1996 Collins et al. .
5,726,392 * 3/1998 Farr et al. ..... 439/587
5,766,039 6/1998 Abe .

FOREIGN PATENT DOCUMENTS 0 407 863 1/1991 (EP) .
2-204980 * 8/1990 (JP) .

* cited by examiner

*Primary Examiner*—Neil Abrams
(74) *Attorney, Agent, or Firm*—Anthony J. Casella; Gerald E. Hespos; Michael J. Porco

(57) ABSTRACT

A one-piece type waterproof rubber plug 30 is formed with round insertion holes 32 whose inner surfaces can be held in sealing contact with the outer surfaces of a plurality of wires 18 individually inserted into the insertion holes 32 to protect them from water. Female terminal fittings 14 having a box-shaped connection portion 15 are introduced into the insertion holes 32. In the inner surfaces of the insertion holes 32 are formed slits 50 in positions corresponding to corner portions 16 of the connection portions 15. While the female terminal fittings 14 are passing the insertion holes 32 by deforming them, the corner portions 16 enter the slits 50, thereby forcibly opening the slits 50 wider to form clearances 51. The corner portions 16 advance along the clearances 51. This prevents the corner portions 16 from damaging or scratching the inner surfaces of the insertion holes 32. After the passage of the female terminal fittings 14, the insertion holes 32 elastically narrow to close the clearances 51, with the result that the lips 33 are held in sealing contact with the outer surfaces of the wires 18. The insertion holes may include guides (140) for passage of terminal stabilizers (25). The guides (140) include closed sealing slits (150) to be forced open by passage of the stabilizers.

15 Claims, 19 Drawing Sheets

SEALING PLUG FOR A WATERTIGHT CONNECTOR AND A WATERTIGHT CONNECTOR

BACKGROUND OF THE INVENTION

1. Field of the Invention.

The present invention relates to a sealing plug, in particular a one-piece type rubber plug for a watertight connector through which plug box-shaped terminal fittings can be inserted. The present invention also is directed to a rubber plug for a watertight connector through which plug terminal fittings having stabilizers are suitably insertable. Furthermore the invention relates to a watertight connector having such a sealing plug.

2. Description of the Related Art.

A prior art one-piece waterproof rubber plug is fittable into an opening in the rear surface of a housing. The housing is formed with cavities and insertion holes are formed in positions in the prior art plug that correspond to the respective cavities. A wire with a terminal fitting at its end is inserted into the housing by first inserting the terminal fitting through the insertion hole of the prior art plug. This insertion of the terminal fitting through the insertion hole causes a widening the insertion hole. The terminal fitting eventually passes through the insertion hole and is accommodated in the corresponding cavity of the housing. The insertion hole then is restored elastically to its original smaller shape, and comes into sealing contact with the outer surface of the wire to provide a secure sealing. If the terminal fitting is box-shaped, the inner surface of the insertion hole may be scratched or damaged by the corner of the box and sealability may not be secured.

A known rubber plug that is used for box-shaped terminal fittings is disclosed in European Patent Application Publication No. 0 407 863 and is shown in FIG. 21. This prior art rubber plug is shaped such that the insertion hole 1 is rectangular at an entrance side in conformity with the outer configuration of the terminal fitting 5 and circular at an exit side so that the insertion holes 1 can be held in sealing contact with the outer surface of wire 6. Further, hollow escape portions 4 are formed around the circular holes 2.

Accordingly, when a box-shaped terminal fitting 5 is inserted, an inner portion 3 of the circular hole 2 displaces toward the escape portion 4, and prevents the inner surface of the circular hole 2 from being scratched or damaged.

The inner portion 3 around the circular hole 2 should come into sealing contact with the outer surface of the wire 6. However, the inner portion 3 is thinned in the prior art construction by forming the escape portion 4 around the circular hole 2. This results in an insufficient elastic force, which is not necessarily satisfactory in view of sealability.

Moreover, many prior art terminal fittings have been formed with stabilizers in recent years to stabilize the insertion of these terminal fittings into cavities and to prevent an upside-down insertion. Insertion of such a prior art terminal fitting may cause the stabilizer to scratch or damage the inner surface of the insertion hole or to damage the stabilizer, thereby resulting in insufficient sealability. As a result, the terminal fittings that have stabilizers cannot be used when this prior art one-piece type rubber plug.

The present invention was developed in view of the above problems and an object thereof is to provide a waterproof plug and a watertight connector, which have a high sealability and which are prevented from a scratch or damage caused by portions of terminal fittings.

SUMMARY OF THE INVENTION

According to the invention, a sealing plug is provided for a watertight connector. The sealing plug is used with at least one wire that has a terminal fitting secured to its end. The wire and the terminal fitting are insertable into the sealing plug. The sealing plug is formed with at least one insertion hole which is sufficiently engageable with the outer surface of the wire to substantially prevent the intrusion of water. One or more slits are formed in the inner surface of the insertion hole in positions that correspond to one or more portions of the terminal fitting. The slits preferably extend from the inner peripheral surface of the insertion hole towards the outer periphery of the sealing plug. The slits also may be provided in positions that correspond to corner portions of the terminal fitting.

According to a further preferred embodiment of the invention, a rubber plug is provided for a watertight connector. The plug is used with at least one wire that has a box-shaped terminal fitting secured to its end. The plug is formed with at least one round hole which is dimensioned to be sufficiently engageable with the outer surface of the wire to prevent the intrusion of water. Slits are formed in the inner surface of the insertion hole in positions that correspond to corner portions of the terminal fitting. Thus, the terminal fitting can be inserted into the hole of the plug such that the corner portions of the terminal fitting enter the slits. Advancement of the terminal fitting into the insertion hole elastically forces the slits to be open more widely. The insertion hole elastically narrows after the passage of the terminal fitting. Hence the slits close and come into sealing contact with the outer surface of the wire. Thus, even if the terminal fitting is box-shaped, the inner surface of the insertion hole is prevented from damage and can be held elastically in sealing contact with the outer surface of the wire over its entire circumference, thereby providing a secure sealing function.

Tapered guide surfaces preferably are formed at an entrance end of the insertion hole to guide the terminal fitting into an orientation where the corner portions of the terminal fitting align substantially with the slits. Thus, the corner portions of the terminal fitting are guided by the guide surfaces to correct the orientation of the terminal fitting. As a result the corner portions will align automatically with the slits even if the terminal fitting is displaced slightly in a circumferential direction when being pressed against the entrance end of the insertion hole. Since it is not necessary to pay much attention to the orientation of the terminal fitting during the insertion, the terminal fitting can be inserted efficiently. The slit may be formed in the inner surface of the insertion hole in a position corresponding to a stabilizer of the terminal fitting.

According to a further preferred embodiment, a rubber plug is provided for a watertight connector. The connector includes a housing that has at least one cavity and the plug may be mounted to the rear end of the housing. The plug is formed with at least one insertion hole in a position on the plug that aligns with the cavity in the housing. The insertion hole is provided for receiving at least one wire that has a terminal fitting secured at its end. The terminal fitting is formed with a stabilizer for stabilizing the orientation of the terminal fitting during the insertion of the terminal into the cavity. A slit is formed in the inner surface of the insertion hole in a position that corresponds to the stabilizer of the terminal fitting.

The terminal fitting can be inserted into the insertion hole with the stabilizer aligned with the slit. Thus the stabilizer forcibly enters and advances along the slit. After the passage of the terminal fitting, the insertion hole elastically narrows and the slit closes into sealing contact with the outer surface of the wire.

The slit for the stabilizer enables the terminal fitting to pass through the insertion hole without damaging or scratching the inner surface of the insertion hole. Thus secure sealing can be provided between the wire and the insertion hole. The terminal fitting with the stabilizer can be used for the watertight connector to ensure sealability, and the terminal fitting can be inserted stably into the cavity while the upside-down insertion of the terminal fitting is prevented.

Preferably, at least one tapered guide surface is formed at an entrance end of the insertion hole for guiding the terminal fitting to a position where the stabilizer is aligned with the slit. Thus the terminal fitting can be guided into the insertion hole by the guide surface, and the orientation of the terminal fitting will be corrected to align the stabilizer with the slit even if the orientation of the terminal fitting initially is displaced slightly. As a result, it is not necessary to pay much attention to the orientation of the female terminal fitting during the insertion, and the terminal fitting can be inserted efficiently.

The terminal fitting preferably is substantially box-shaped and has corner portions. Corner slits are formed in the inner surface of the insertion hole and extend substantially radially in positions that correspond to the corner portions of the terminal fitting.

The corner portions of the terminal fitting enter and advance along the corner slits, and elastically force the corner slits to open more widely as the terminal fitting is passed through the insertion hole. After the passage of the terminal fitting, the insertion hole elastically narrows, and the corner slits are closed into sealing contact with the outer surface of the wire.

A sealing function can be fulfilled securely, since the inner surface of the insertion hole can be prevented from damage and scratches and can be held elastically in sealing contact with the outer surface of the wire over its entire circumference even if the terminal fitting is box-shaped.

Still further preferably, one or more projections or inner lips are provided in an inner portion of the insertion hole to come into substantially close contact with the wire inserted therethrough. Accordingly, the sealing property of the sealing plug can be improved.

Still further preferably, one or more outer lips preferably are provided circumferentially on the outer lateral surface of the sealing plug that contact the connector housing. Accordingly, the sealing between the housing and the sealing plug can be improved thereby improving the overall sealability of the arrangement.

Most preferably, the plug is formed integrally or unitarily of rubber.

According to the invention, there is further provided a watertight connector that comprises a connector housing with one or more cavities for accommodating one or more terminal fittings. At least one sealing plug, such as the sealing plug described above, is positionable in a receptacle of the connector housing. The sealing plug can come into sealing engagement with one or more wires connected with the terminal fittings.

According to a preferred embodiment, the sealing plug is mounted on the connector housing by means of a mounting member.

These and other objects, features and advantages of the present invention will become more apparent upon a reading of the following detailed description and accompanying drawings.

DETAILED DESCRIPTION OF THE PREFERRED EMBODIMENTS

Figure 1:
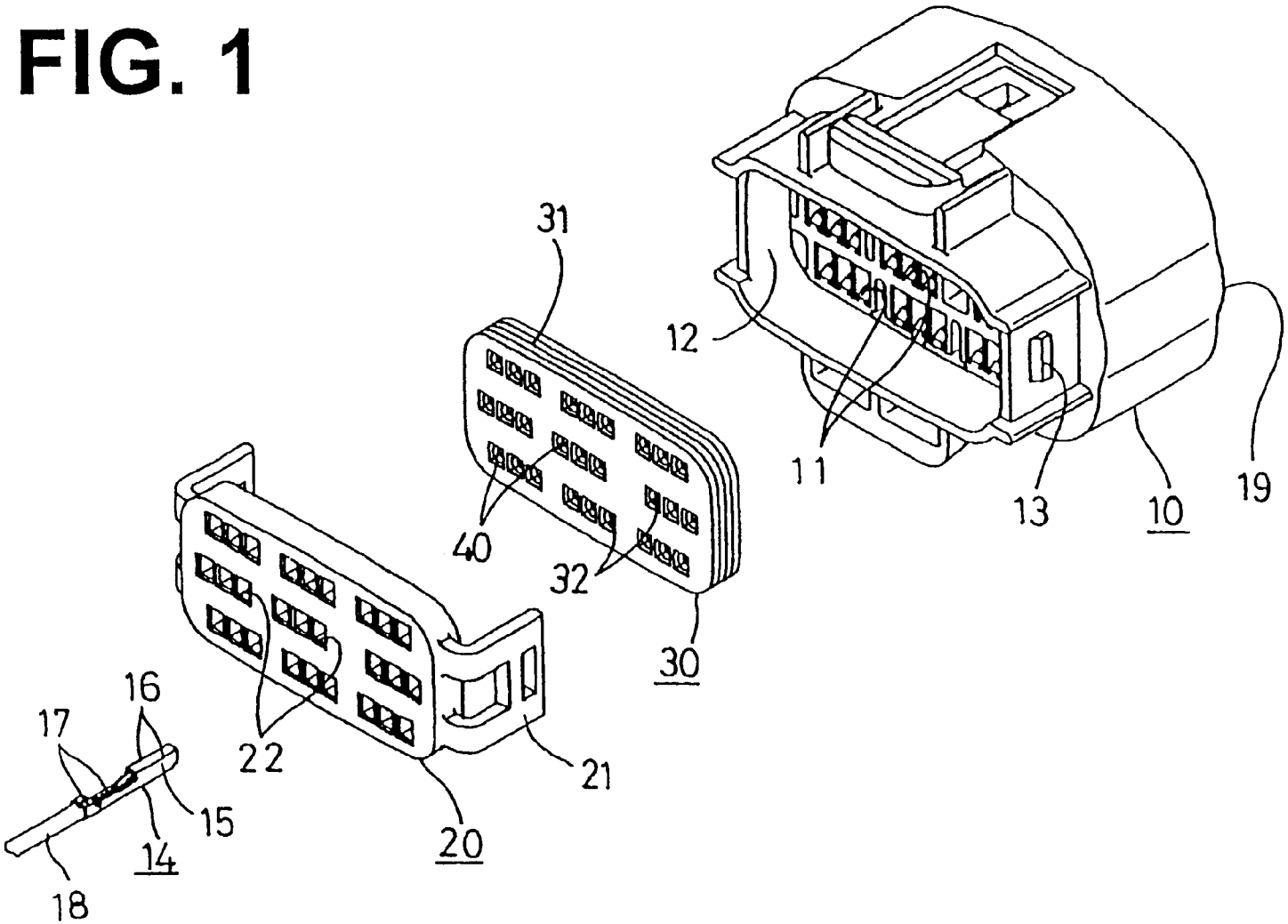
FIG. 1 is an exploded perspective view of a female watertight connector according to one embodiment of the invention.

A one-piece waterproof rubber plug in accordance with the subject invention is identified by the numeral 30 in FIGS. 1 to 7. The waterproof rubber plug 30 is provided at the rear side of a female connector housing 10 (hereinafter, female housing 10) for collectively protecting a plurality of wires 18 from water. A pushing or holding member 20 also is provided at the rear side of the housing 10. The waterproof rubber plug 30 and the pushing member 20 are successively mounted in this order.

The female housing 10 is made e.g. of a synthetic resin material and a plurality of cavities 11 preferably are formed in three stages in the housing 10 for individually accommodating female terminal fittings 14 secured to ends of wires 18. An unillustrated mating male housing is fittable into a receptacle 19 formed at the front side of the female housing 10 or at an end of the female housing 10 to be mated with the rubber plug 30. On the other hand, an opening 12 is formed at the rear end of the female housing 10. The waterproof rubber plug 30 and the pushing member 20 are mounted at least partly into or on the opening 12 from behind.

The waterproof rubber plug 30 has a plurality of lips 31 formed on its outer circumferential surface for sealing contact with the inner surface of the opening 12. On the other hand, a plurality of insertion holes 32 are formed in positions corresponding to the cavities 11 of the female housing 10. The female terminal fittings 14 can be introduced through the insertion holes 32, as described in detail later, and the wires 18 connected with the terminal fittings 14 are held in sealing contact with the inner surfaces of the insertion holes 32.

The pushing or holding member 20 (mounting member) is mounted to push or hold the waterproof rubber plug 30 from behind. Locking arms 21 project forwardly from the lateral or left and right surfaces of the pushing member 20, and are engageable with locking portions 13 that project from the outer surface of the opening 12 of the female housing 10. The pushing member 20 is formed with through holes 22 which can communicate with the insertion holes 32.

The female terminal fitting 14 is comprised of a substantially box-shaped connection portion 15 provided at the front of the female terminal fitting 14. Two barrel portions 17 are provided behind the connection portion 15, and can be fastened to an insulating coating and a core at the end of the wire 18. The connection portion 15 preferably has four corner or edge portions 16 due to its box-shape. Further, a connection piece (not shown) is provided in the connection portion 15, and is connectable with a mating male terminal fitting that can be inserted from the front.

Figure 3:
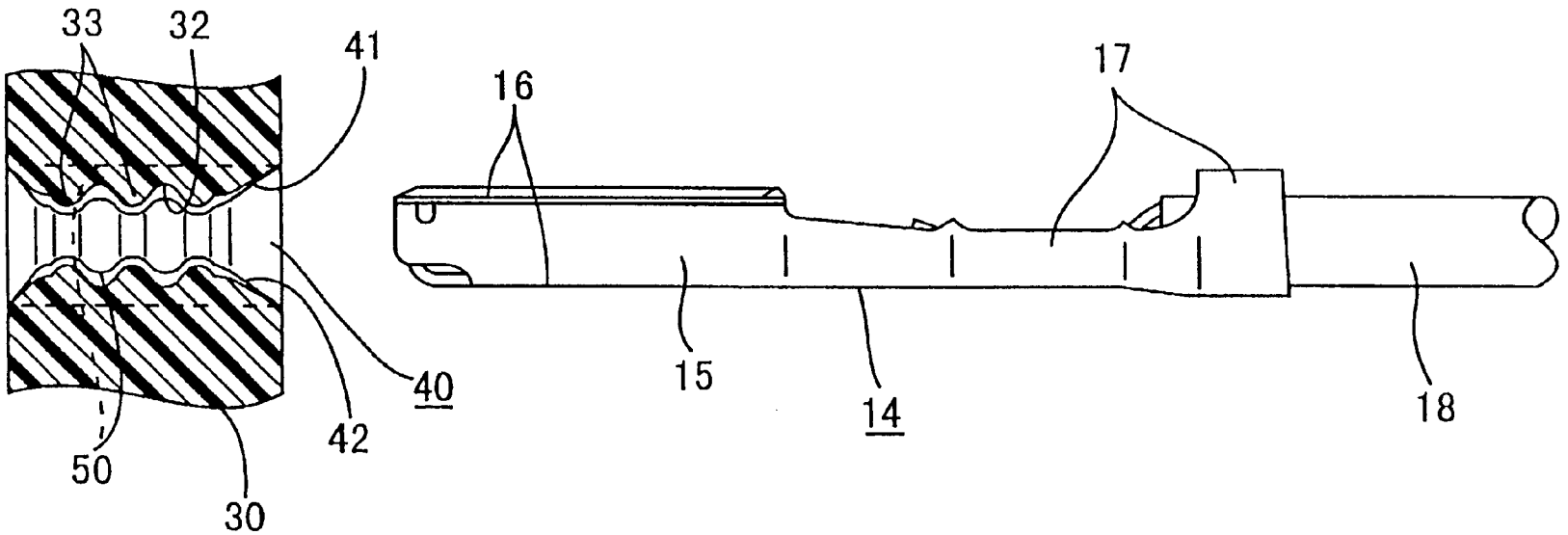
FIG. 3 is a side view partly in section along line 3—3 of FIG. 2.
Figure 4:
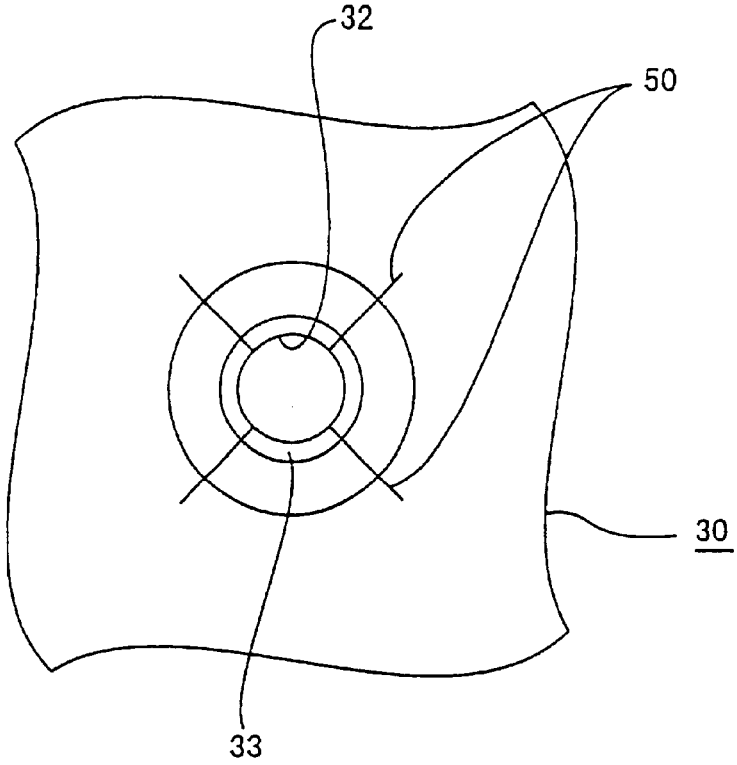
FIG. 4 is a rear view of the waterproof rubber plug.
Figure 5:
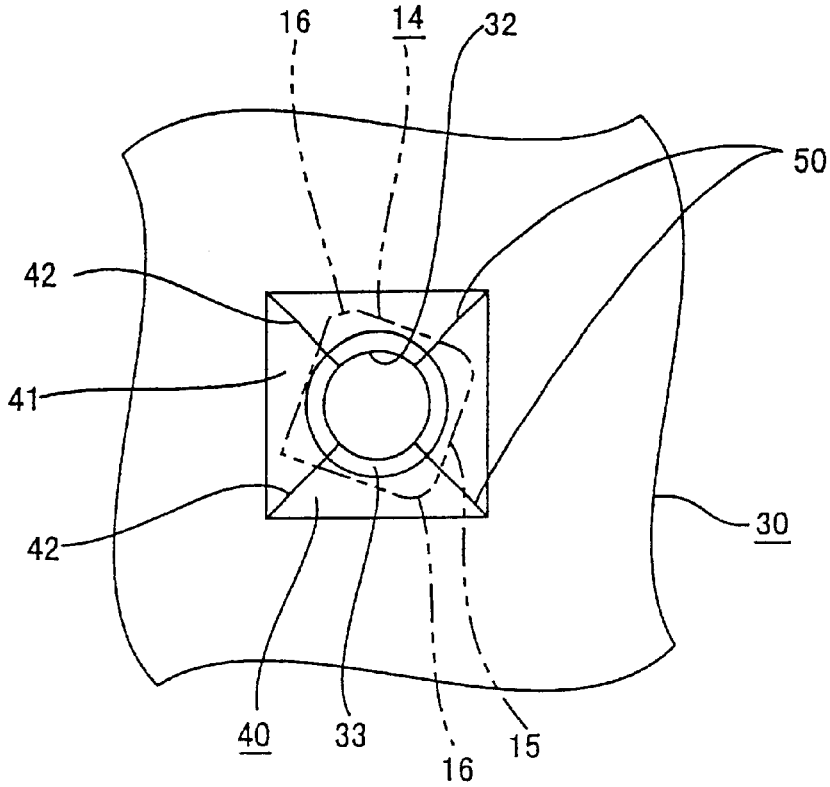
FIG. 5 is a front view showing a state where the female terminal fitting is in contact with a guide portion while being circumferentially displaced.

Each insertion hole 32 is round, and substantially conforms to the shape of the wire 18. Additionally, each insertion hole 32 penetrates through the waterproof rubber plug 30 to open in the front and rear surfaces thereof as shown in FIG. 3. One or more, e.g. three, lips or projections 33 are formed on the inner surface of the insertion hole 32 as shown. The inner diameter of the lips 33 are smaller than the outer diameter of the wire 18, so that the lips 33 can be held in sealing contact with the outer surface of the inserted wire 18.

Figure 2:
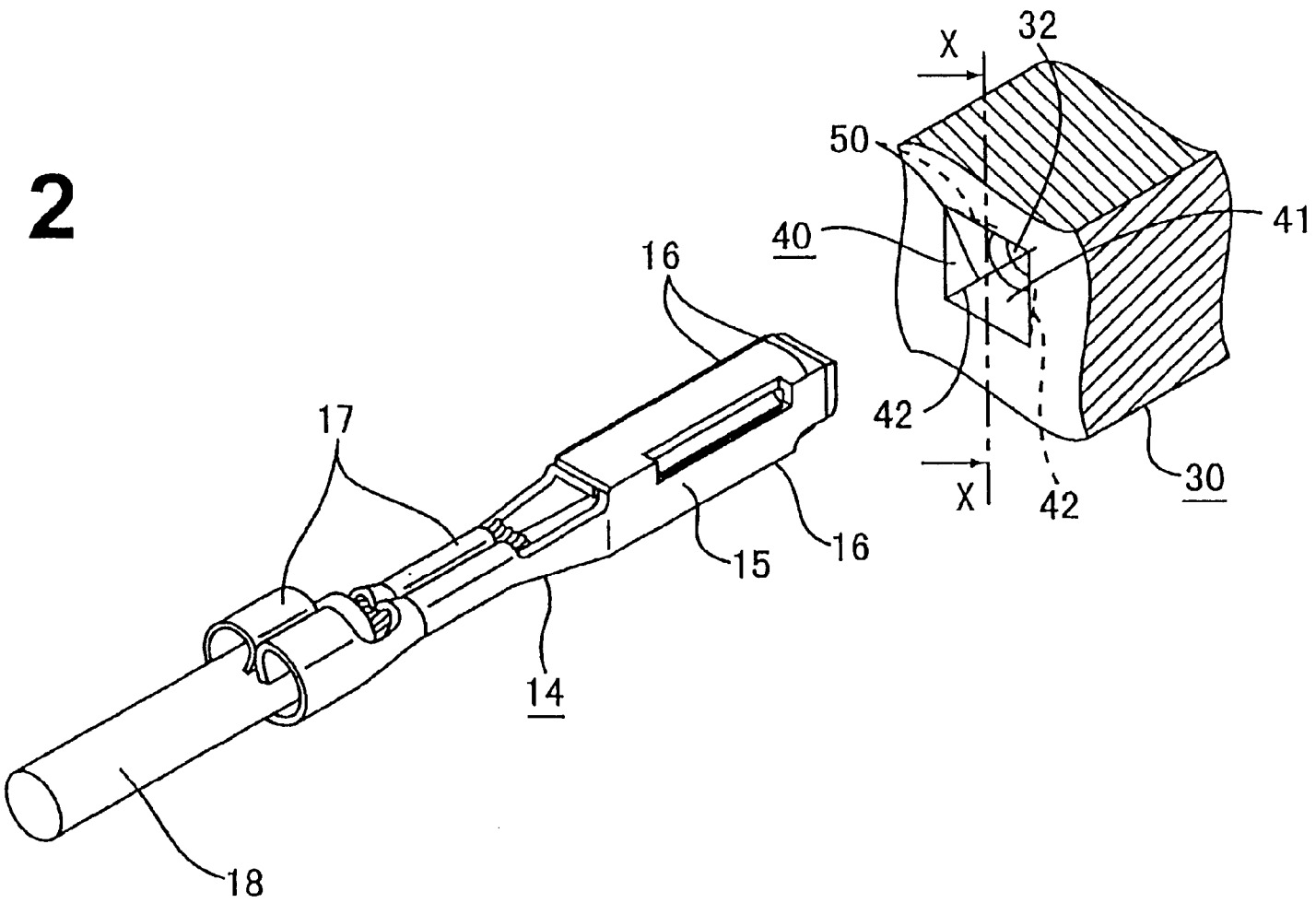
FIG. 2 is an enlarged perspective view showing a waterproof rubber plug and a female terminal fitting.

The rear end of the insertion hole 32 of the waterproof rubber plug 30 is provided with a guide portion 40 as shown in FIG. 2. The guide portion 40 is formed to have a substantially square cross section that is larger than the cross section of the connection portion 15 of the female terminal fitting 14 at its entrance side. The inner surface of the guide portion 40 preferably is tapered to have a shape substantially of a truncated rectangular pyramid from the entrance toward the inside. The back side of the guide portion 40 communicates with the insertion hole 32. In other words, the inner surface of the guide portion 40 is made up of four slanted surfaces 41 which gradually project toward the center as the guide portion extends toward the back.

The respective corner portions 16 of the connection portion 15 can come into contact with oblique sides 42 between the respective slanted surfaces 41 of the guide portion 40 thus formed when the female terminal fitting 14 is oriented properly. Slits 50 of a specified depth are formed to extend along the oblique sides 42 up to the front surface of the waterproof rubber plug 30.

As shown in FIG. 1, the waterproof rubber plug 30 is fitted to the opening 12 of the female housing 10. The pushing member 20 then is mounted by engaging the locking arms 21 thereof with the locking portion 13 of the opening 12. Subsequently, the female terminal fittings 14 that are fastened to the ends of the wires 18 are passed through the through holes 22 of the pushing member 20, and are inserted into the insertion holes 32 of the waterproof rubber plug 30.

The guide portion 40 is provided at the entrance end of each insertion hole 32. As a result, the corner portions 16 of the connection portion 15 are guided by the slanted surfaces 41 of the guided portion 40, and are brought into contact with the oblique sides 42 even if the female terminal fitting 14 is inserted while being slightly circumferentially displaced. Since the orientation of the female terminal fitting 14 is automatically corrected, it is not necessary to pay attention to the orientation during the insertion.

Figure 6:
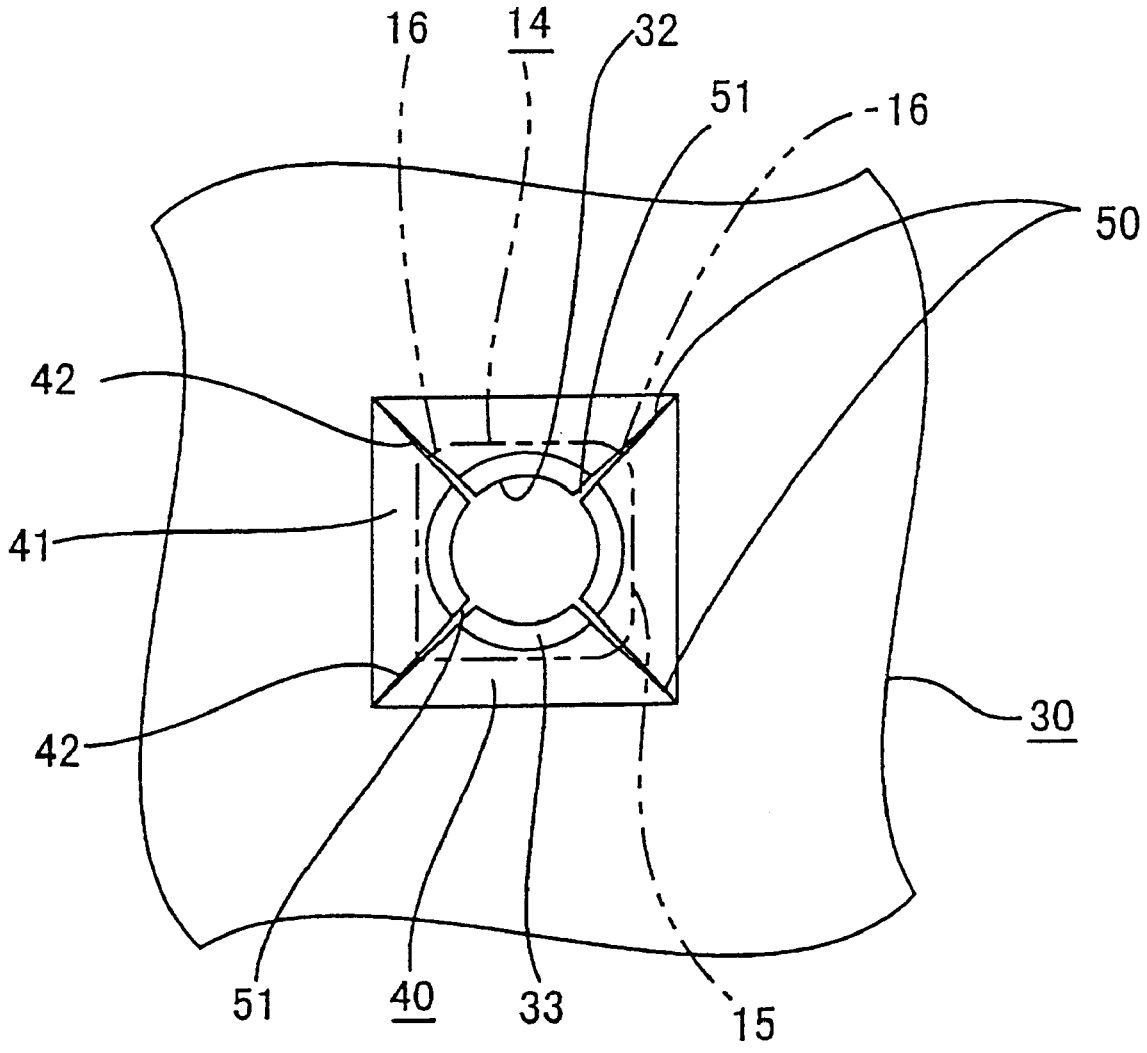
FIG. 6 is a front view showing a state where slits are forcibly opened wider by corner portions.

The female terminal fitting 14 is pushed further into the insertion hole 32 in a state where the corner portions 16 are in contact with the oblique sides 42 of the guide portion 40. Thus the corner portions 16 are forced into the slits 50, and open them more widely. The corner portions 16 then advance along clearances 51 formed there as shown in FIG. 6. Thus, there is no likelihood that the corner portions 16 will be caught by the lips 33, and damage or tearing to the inner surface of the insertion hole 32 is prevented. In view of the insertion described above, the female terminal fitting 14 is accommodated at least partly in the cavity 11 of the female housing 10 after passing through the insertion hole 32.

Figure 7:
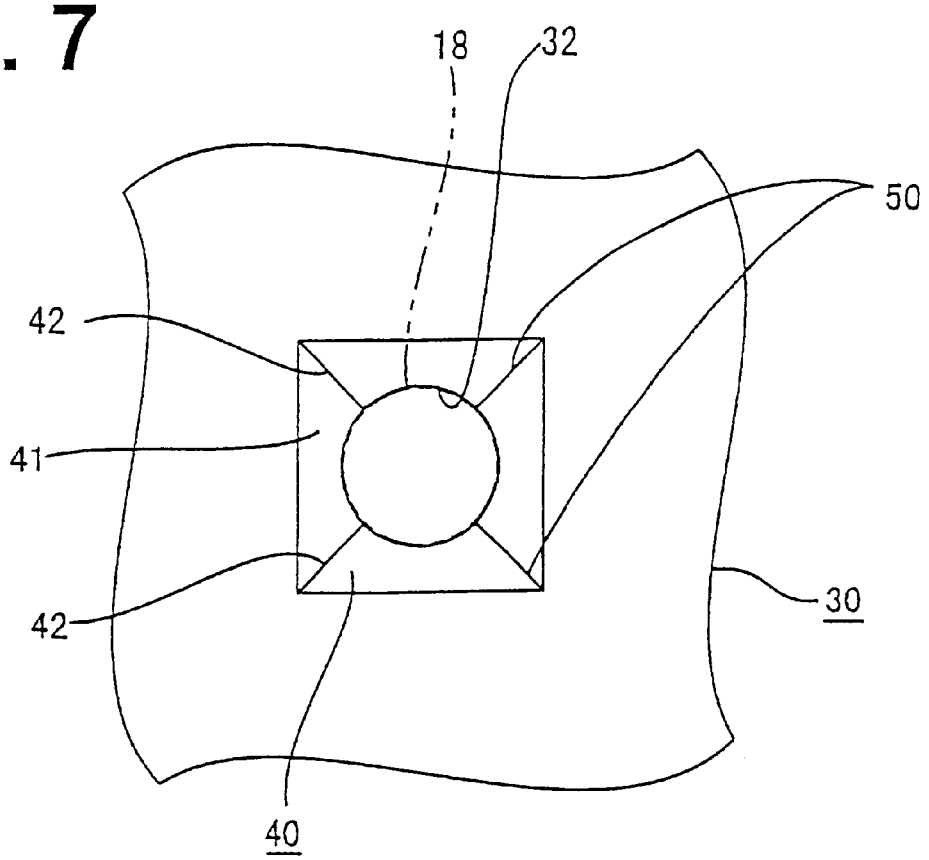
FIG. 7 is a front view showing a state where a wire is inserted into an insertion hole.

The wire 18 is introduced into the insertion hole 32, as shown in FIG. 7, after the female terminal fitting 14 passes through the plug 30. The insertion hole 32, which had been widened by the female terminal fitting 14, elastically narrows toward the cross sectionally smaller wire 18, and the clearances 51 close. As a result, the lips 33 are held in sealing contact with the outer surface of the wire 18. At this time, four fan- or cloverleaf-shaped or trapezoidal portions divided by the slits 50 are compressed radially outwardly and are deformed into a flat shape to escape the lateral end surfaces in lateral directions. Thus, the end surfaces of the adjacent fan-shaped portions with the slits 50 therebetween are pressed toward each other to closely abut against each other. Therefore, the lips 33 on the inner surface of the insertion hole 32 are held in sealing contact with the outer surface of the wire 18 over its entire circumference, and provide secure sealing around the wire 18.

As described above, the slits 50, according to this embodiment, are formed in the inner surface of each insertion hole 32 of the waterproof rubber plug 30 at locations selected to align with the corner portions 16 of the connection portion 15 of the female terminal fitting 14. Thus, the corner portions 16 are permitted to pass through the insertion hole 32 by forcibly opening the slits 50 wider when the female terminal fitting 14 is passed through the insertion holes 32. This prevents the corner portions 16 from getting caught by the inner surface of the insertion hole 32, and hence prevents the corner portions 16 from scratching or damaging the inner surface of the insertion hole 32. The insertion hole 32 elastically narrows after the passage of the female terminal fitting 14, and the slits 50, which had been forcibly opened wider by the insertion of the female terminal fitting 14, are closed. As a result, the lips 33 are held elastically substantially in sealing contact with the outer surface of the wire 18, and provide a secure sealing function.

The tapered guide portions 40 are formed at the entrance end of the insertion hole 32. Thus, the female terminal fitting 14 is corrected to its proper orientation by the slanted surfaces 41 of the guide portion 40 even if the female terminal fitting 14 is slightly displaced in circumferential direction during insertion into the insertion hole 32. Therefore, it is not necessary to pay much attention to the orientation of the female terminal fitting 14 during the insertion, and a more efficient inserting operation of the female terminal fitting 14 is achieved.

Another embodiment of the invention is described with reference to FIGS. 8 to 15. In this embodiment female terminal fittings with stabilizers are inserted through a one-piece type waterproof rubber plug that is used for a female watertight connector. In particular, a waterproof rubber plug 30 is provided at the rear side of a female connector housing 10 (hereinafter, female housing 10) for collectively protecting a plurality of wires 28 from water. The wires 28 are provided with female terminal fittings 23 at their ends. A pushing member 20 is mounted over the waterproof rubber plug 30 and is secured to the female housing 10.

The female housing 10 is made, for example, of a synthetic resin material and a plurality of cavities 11 are formed therein for individually accommodating the female terminal fittings 23 that are secured to ends of the wires 28. An unillustrated mating male housing is fittable into a receptacle 112 formed at the front side of the female housing 10. On the other hand, an opening 113 is formed at the rear end of the female housing 10. The waterproof rubber plug 30 and the pushing member 20 are or can be mounted into the opening 113 from behind.

The waterproof rubber plug 30 has a plurality of lips 31 formed on its outer circumferential surface for holding the waterproof rubber plug 30 in sealing contact with the inner surface of the opening 113. A plurality of insertion holes 32 are formed through the waterproof rubber plug 30 in positions that correspond to the location of the cavities 11 of the female housing 10. The female terminal fittings 23 can be introduced through the insertion holes 32, as described in detail later, and the wires 28 that extend behind the female terminal fittings 23 are held in sealing contact with the inner surfaces of the insertion holes 32.

The pushing member 20 is mounted to push the waterproof rubber plug 30 from behind. Locking arms 21 project forwardly from the left and right surfaces of the pushing member 20, and are engageable with locking portions 114 that project from the outer surface of the opening 113 of the female housing 10. The pushing member 20 is formed with through holes 22 which can communicate with the insertion holes 32. Thus the female terminal fittings 23 can be inserted through the through holes 22 from behind. A groove is formed at a bottom right portion of each through hole 22 for permitting the passage of a stabilizer of the female terminal fitting 23 to be described below.

The female terminal fitting 23 is comprised of a substantially box-shaped connection portion 24 provided at the front and two barrel portions 27 provided behind the connection portion 24. The barrel portions 27 are to be fastened to an insulating coating and a core at an end of the wire 28. A stabilizer 25 projects downwardly from the lateral or right edge of the bottom surface of the connection portion 24 as shown in FIG. 9. The stabilizer 25 can be aligned with a groove (not shown) formed in the bottom surface of the cavity 11 when the female terminal 23 is to be inserted into the cavity 11 of the female housing 10. The female terminal fitting 23 can be inserted stably by fitting and passing the stabilizer 25 along the groove (see FIG. 8). The connection portion 24 preferably is substantially box-shaped, and has four corner portions 26. Further, a connection piece (not shown) is provided in the connection portion 24, and is connectable with a mating male terminal fitting to be inserted from front.

Figure 10:
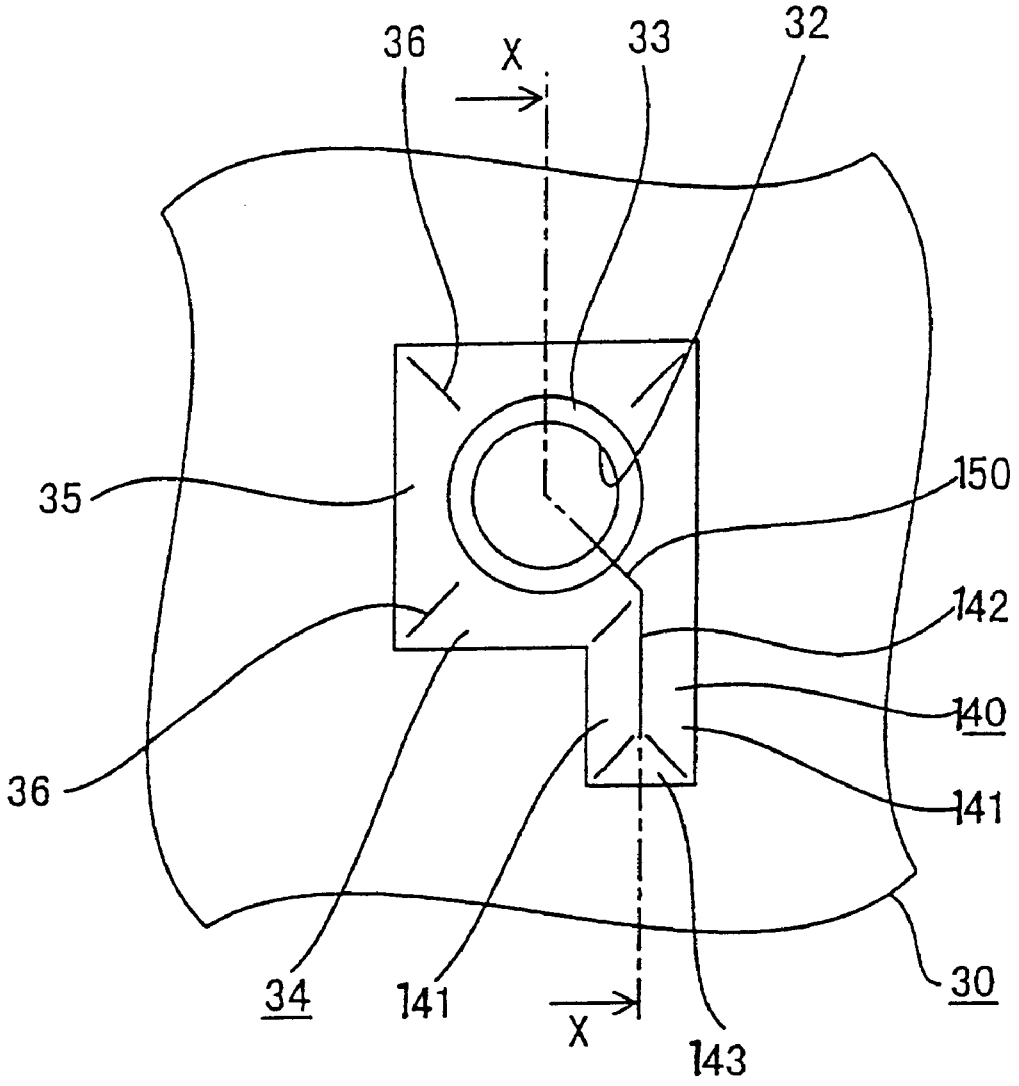
FIG. 10 is a front view of the waterproof rubber plug.
Figure 11:
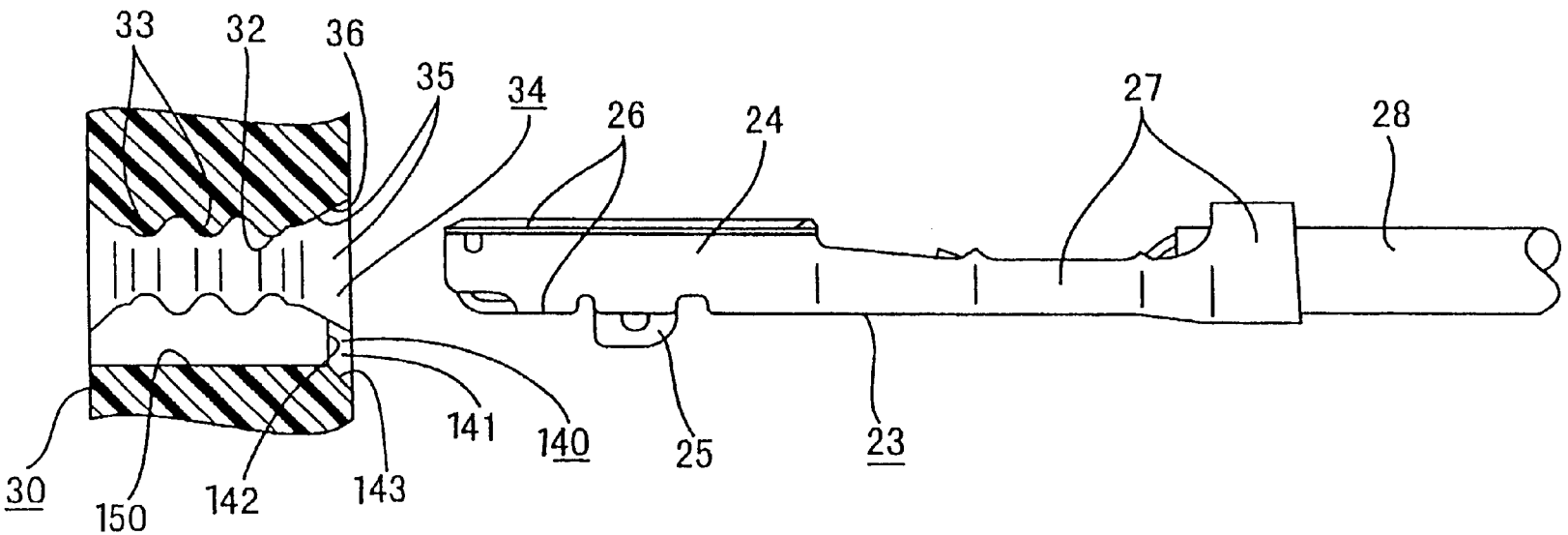
FIG. 11 is a side view partly in section along line 11—11 of FIG. 10.
Figure 12:
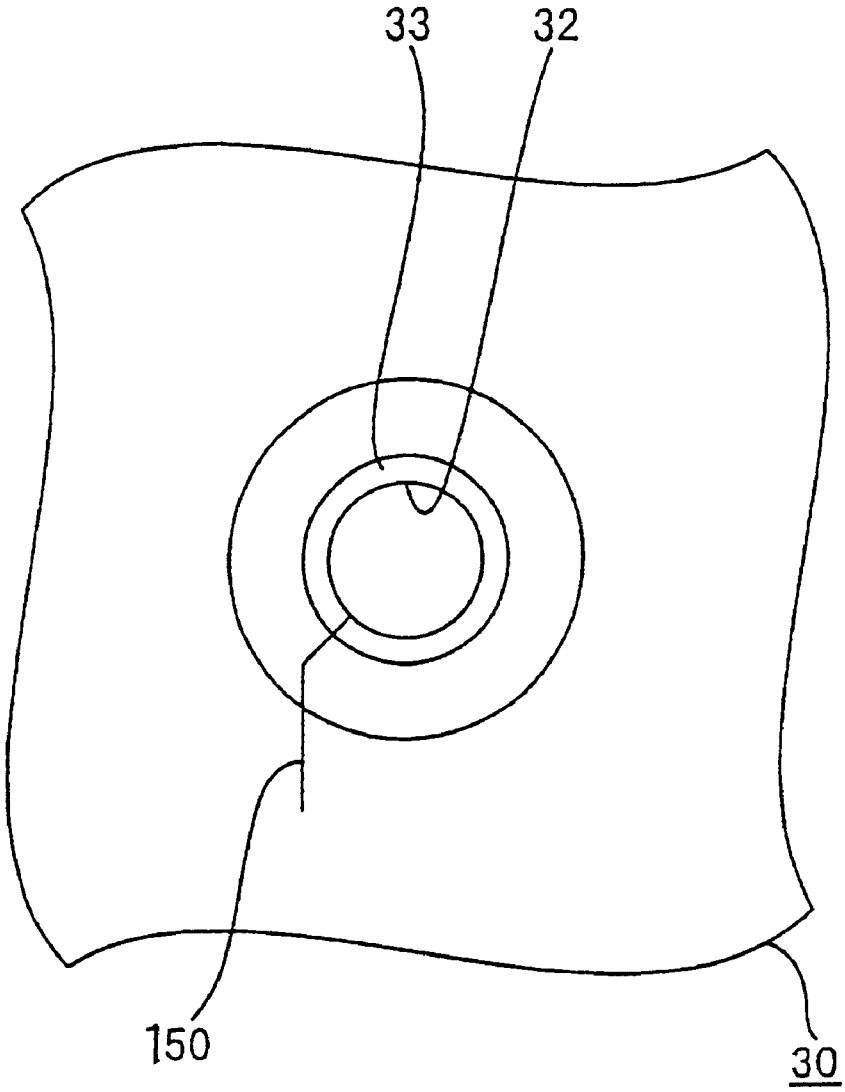
FIG. 12 is a rear view of the waterproof rubber plug.

The insertion holes 32 of the waterproof rubber plug 30 are substantially round and conform to the shape of the wire 28. Each insertion hole 32 penetrates through the waterproof rubber plug 30 to open in the front and rear surfaces thereof as shown in FIGS. 10 and 11. Three lips 33 are formed on the inner surface of each insertion hole 32 as shown. The inner diameter of each lip 33 is set smaller than the outer diameter of the wire 28. Thus the lips 33 can be held in sealing contact with the outer surface of the inserted wire 28.

A first guide portion 34, as shown in FIGS. 9 to 11, is provided at the rear end of the insertion hole 32 of the waterproof rubber plug 30. The first guide portion 34 has a substantially square cross section that is larger than the cross section of the connection portion 24 of the female terminal fitting 23 at its entrance side. The inner surface of the first guide portion 34 is tapered to have a shape substantially of a truncated rectangular pyramid from the entrance toward the inside. The back side of the first guide portion 34 communicates with the insertion hole 32. In other words, the inner surface of the first guide portion 34 is made up of four slanted surfaces 35 which gradually project toward the center as the guide portion extends toward the back. The respective corner portions 26 of the connection portion 24 of the female terminal fitting 23 can come into contact with oblique sides 36 that are located between the respective slanted surfaces 35 of the first guide portion 34.

A bottom right portion of the first guide portion 34 preferably is recessed substantially rectangularly downwardly over a specified width, thereby forming a groove-shaped second guide portion 140. The second guide portion 140 is a groove having a triangular horizontal cross section. Left and right inner slanted surfaces 141 meet at the back to form a groove bottom 142. Further, a slanted surface 143 substantially extends inwardly from the bottom side of the second guide portion 140. The groove bottom 142 extends vertically straight and is provided in a position to be contacted by the stabilizer 25 when the female terminal fitting 23 is oriented properly. A slit 150 of a specified depth is formed along the groove bottom 142. The slit 150 is formed to communicate with the insertion hole 32 and substantially extends up to the front surface of the waterproof rubber plug 30 as shown in FIG. 1.

Figure 8:
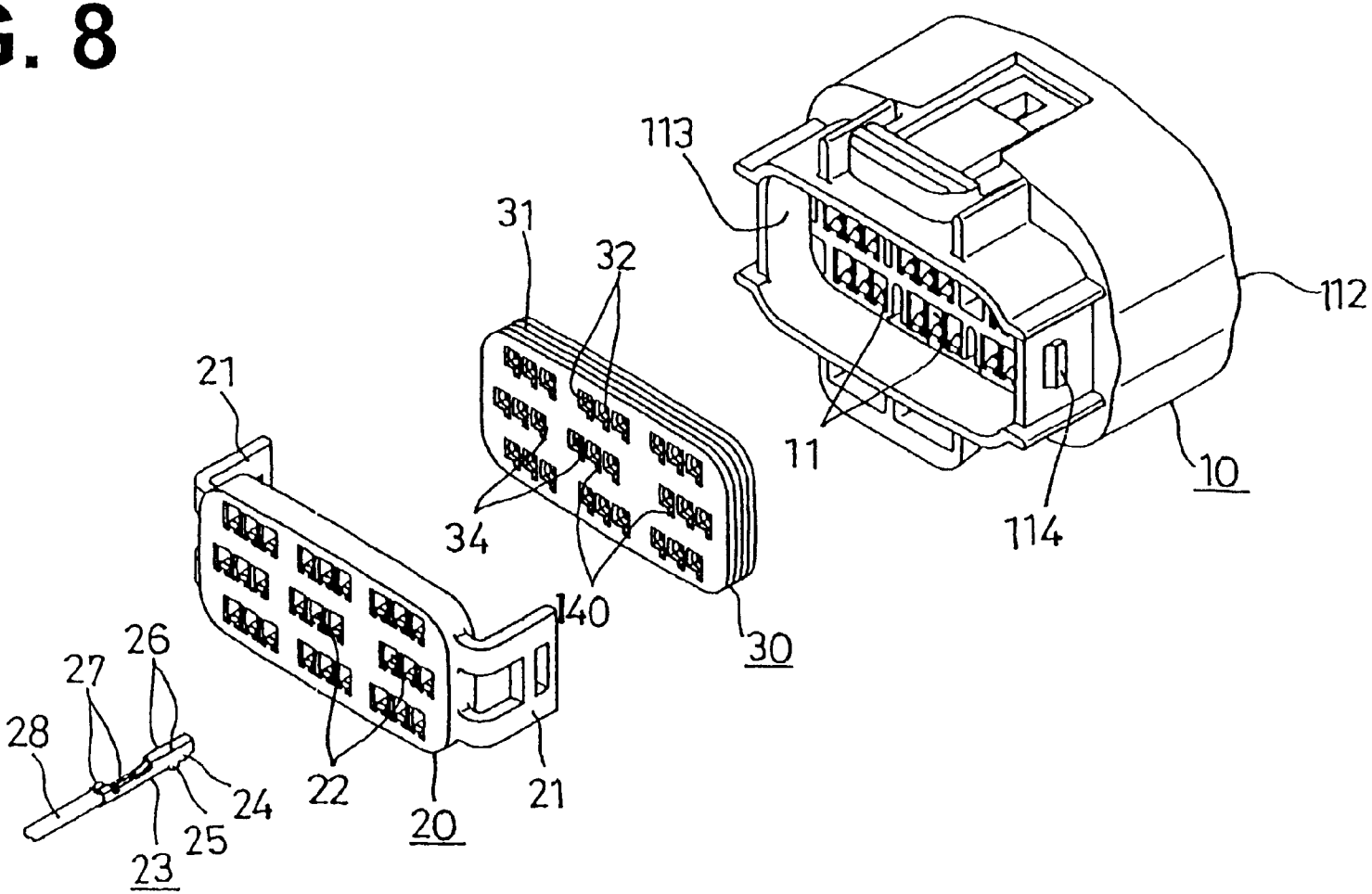
FIG. 8 is an exploded perspective view of a watertight connector according to another embodiment of the invention.
Figure 9:
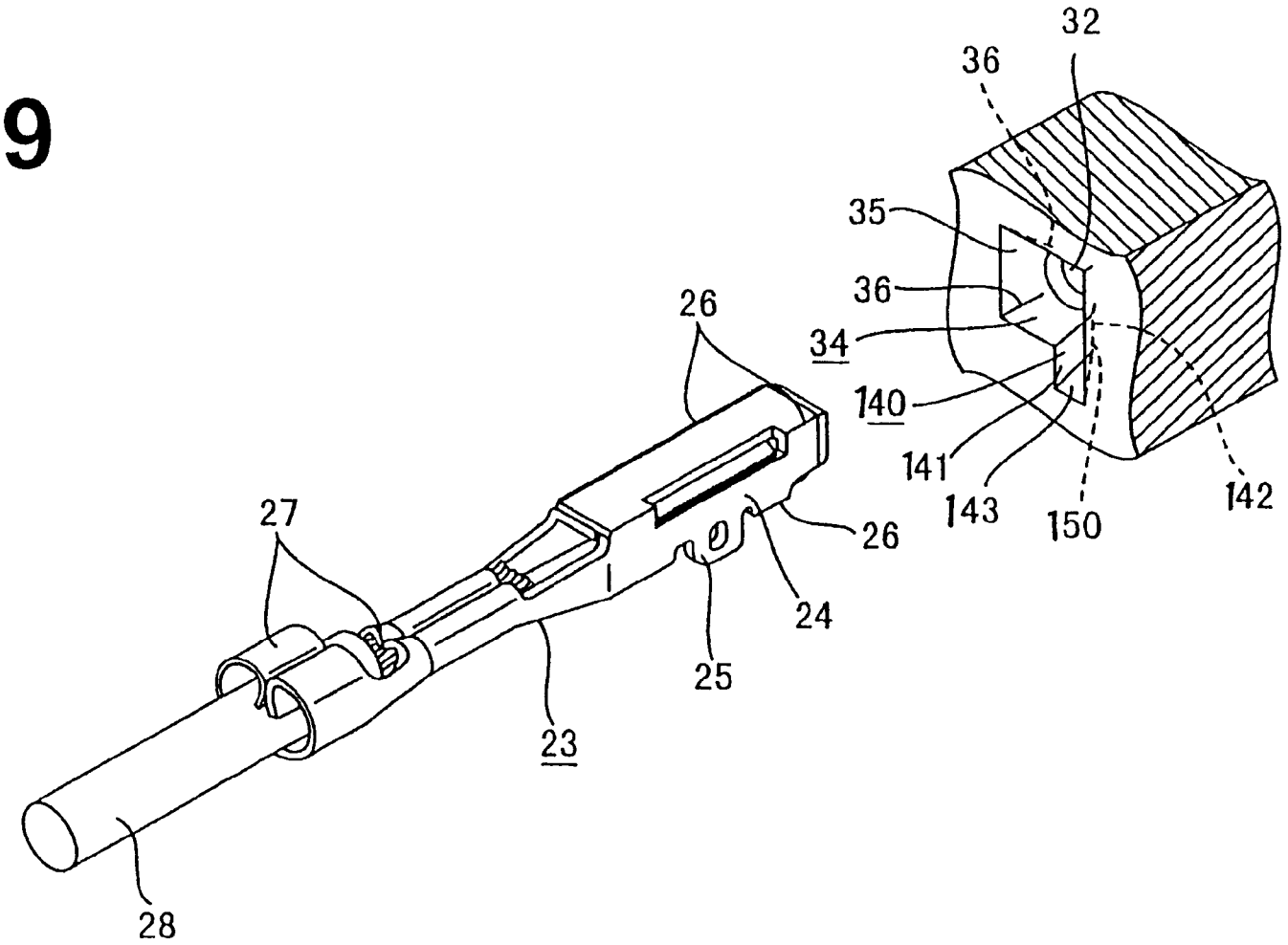
FIG. 9 is an enlarged perspective view showing a waterproof rubber plug and a female terminal fitting.

As shown in FIG. 8, the waterproof rubber plug 30 is fitted into the opening 113 of the female housing 10, and then the pushing member 20 is mounted to the female housing 10 by engaging the locking arms 21 of the pushing member 20 with the locking portion 14 of the opening 113. Subsequently, the stabilizer 25 of the female terminal fitting 23 is aligned with the groove of the through hole 22 in the pushing member 20, and the female terminal fitting 23 fastened to the end of the wire 28 is inserted into the through hole 22 of the pushing member 20. The female terminal fitting 23 that has passed through the through hole 22 then is inserted into the insertion hole 32 of the waterproof rubber plug 30.

Figure 13:
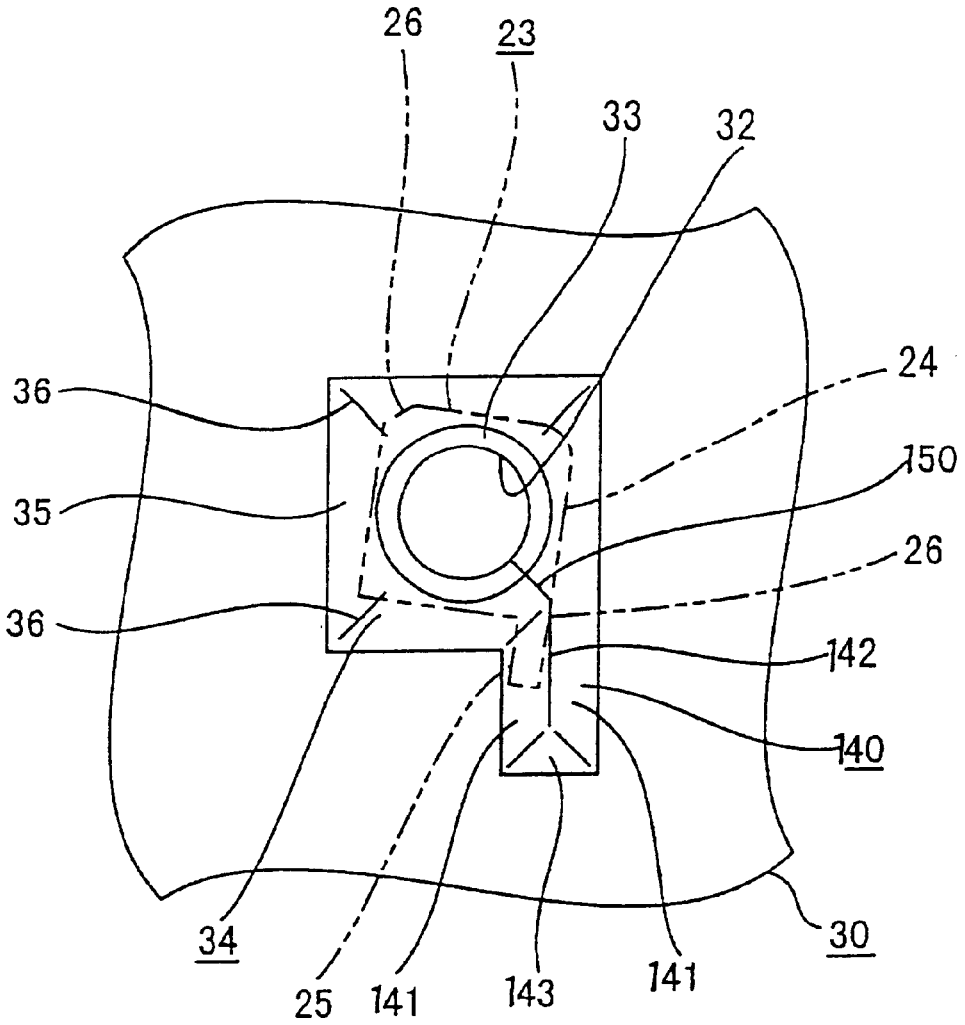
FIG. 13 is a front view showing a state where the female terminal fitting is in contact with a first guide portion while being substantially circumferentially displaced.
Figure 14:
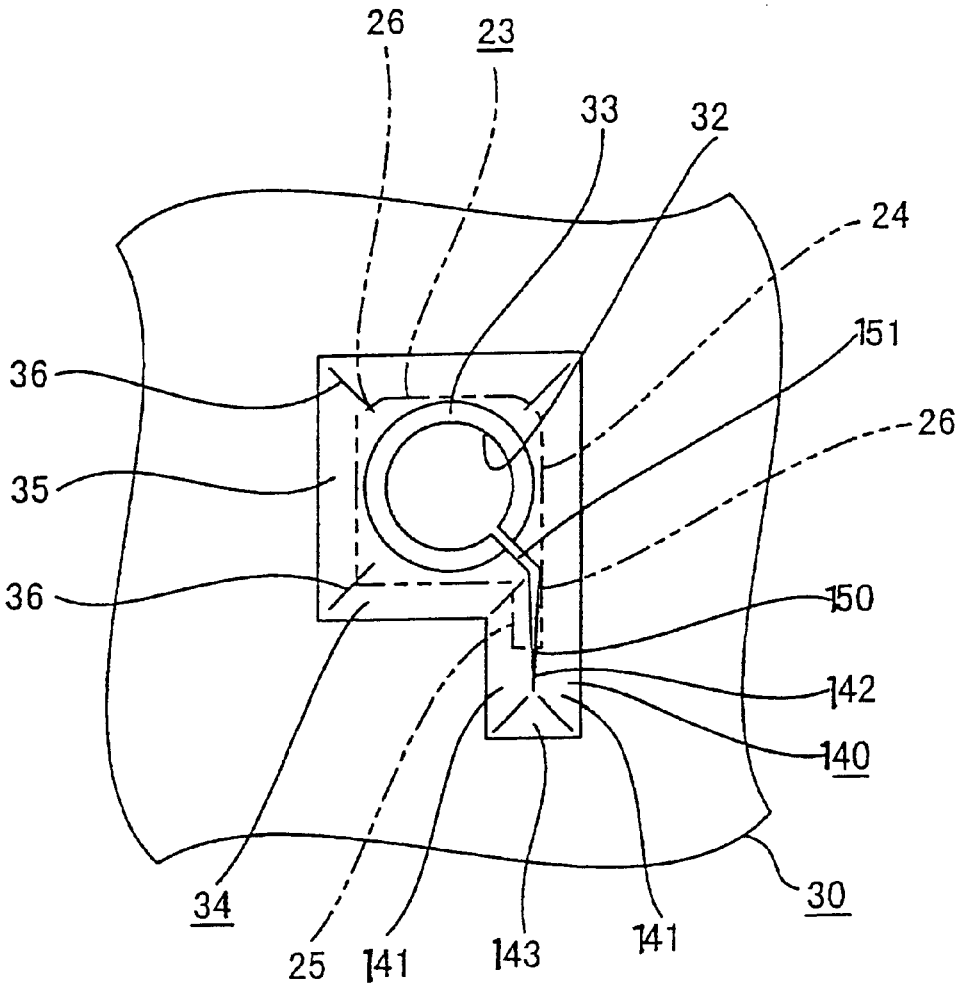
FIG. 14 is a front view showing a state where a connection portion of the female terminal fitting is inserted in an insertion hole.

At this time, the corner portions 26 of the connection portion 24 are guided toward the oblique sides 36 by the slanted surfaces 35 of the first guide portion 34, and any circumferential displacement of the female terminal fitting 23 that might have existed is substantially corrected, as shown in FIG. 13. When the female terminal fitting 23 is pushed further into the insertion hole 32, the insertion hole 32 is widened substantially entirely and the bottom right corner portion 26 forcibly opens an oblique portion of the slit 150 to enter a clearance 151 formed there as shown in FIG. 14. A vertical portion of the slit 150 also is opened slightly as this corner portion 26 advances.

The stabilizer 25 enters the second guide portion 140 when the female terminal fitting 23 is pushed further. At this time, the female terminal fitting 23 may be displaced circumferentially to a small degree due to a pressure created during the insertion. However, the stabilizer 25 is guided toward the groove bottom 142 at the back along the slanted surfaces 141 of the second guide portion 140. Hence the stabilizer 25 can be brought securely into contact with the groove bottom 142.

Continued insertion of the female terminal fitting 23 causes the stabilizer 25 to enter the already opened slit 150, thereby forcing the slit 150 to open more widely. The stabilizer 25 then passes along the clearance 151 formed there. Thus, there is no likelihood that the stabilizer 25 will be caught by the lips 33, and consequently damage or tears to the inner surface of the insertion hole 32 can be avoided. After passing through the insertion hole 32, the female terminal fitting 23 is accommodated in the corresponding cavity 11 located in the front of the female housing 10. The female terminal fitting 23 is moved forward with the stabilizer 25 fitted in the groove of the cavity 11. As a result, the female terminal fitting 23 can be inserted stably into the cavity 11 and shaking of the female terminal fitting 23 after the insertion can be suppressed.

Figure 15:
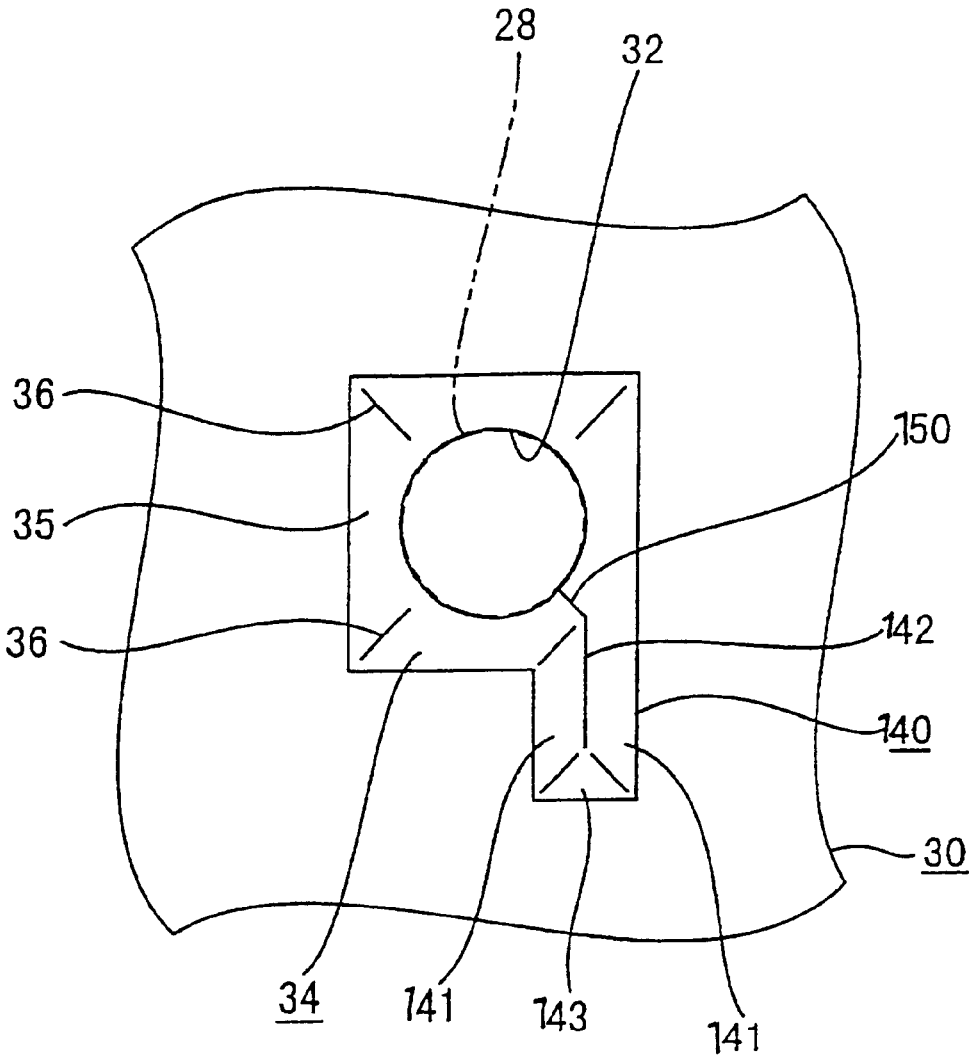
FIG. 15 is a front view showing a state where a wire is inserted in the insertion hole.
Figure 16:
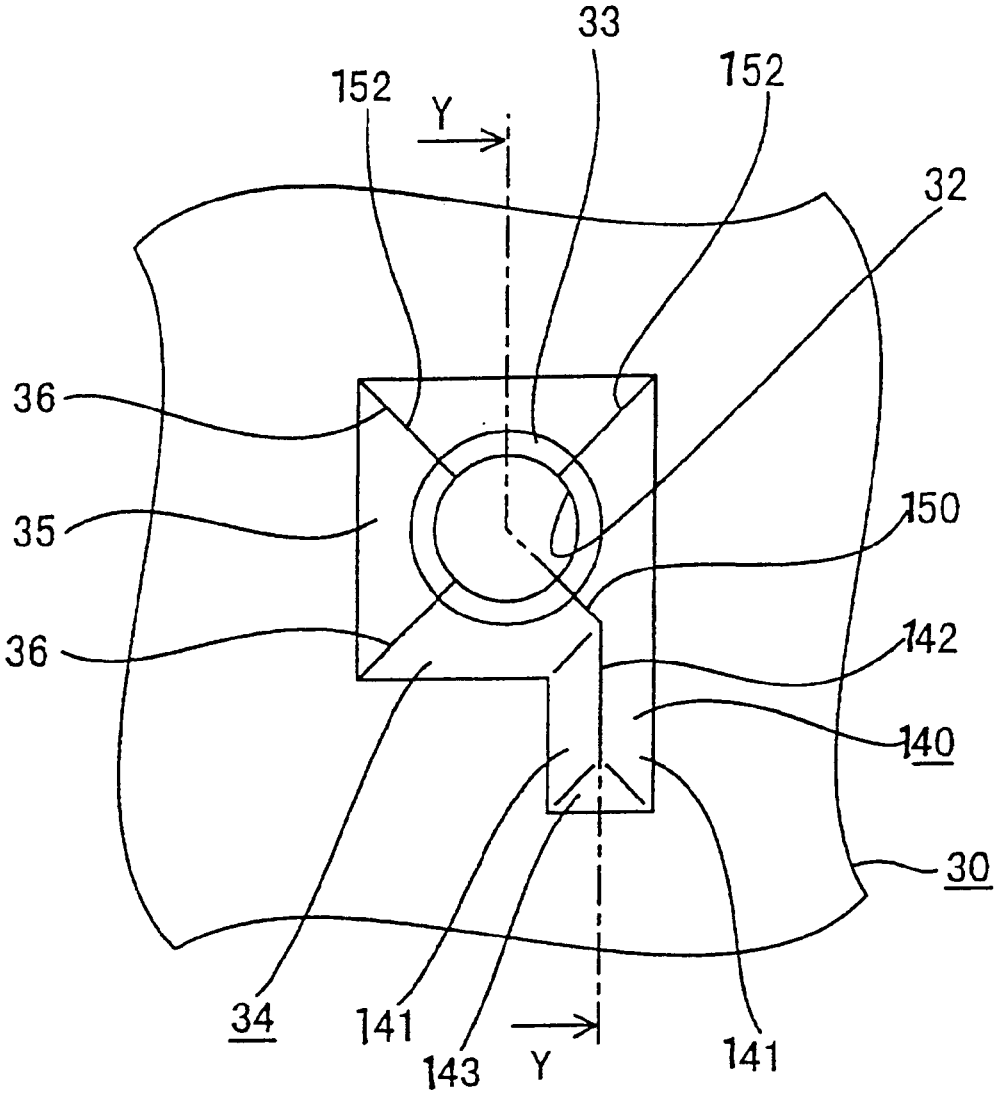
FIG. 16 is a front view of a waterproof rubber plug according to still another embodiment of the invention.
Figure 17:
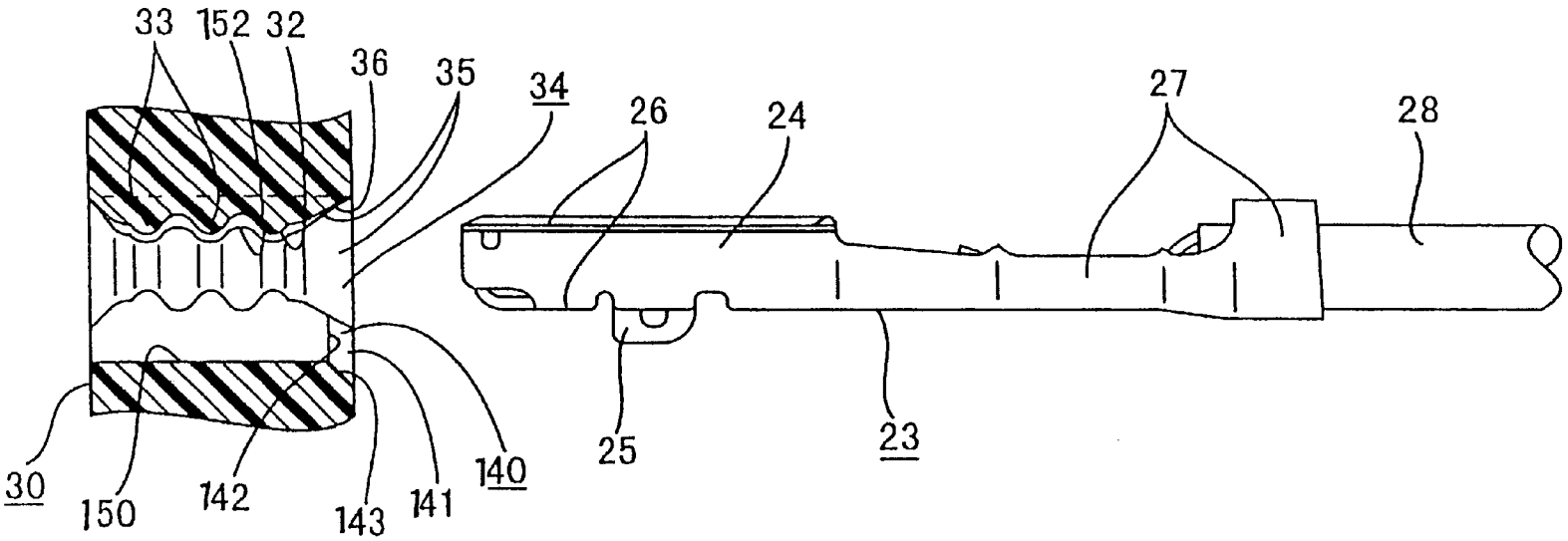
FIG. 17 is a side view partly in section along line 17—17 of FIG. 16.
Figure 18:
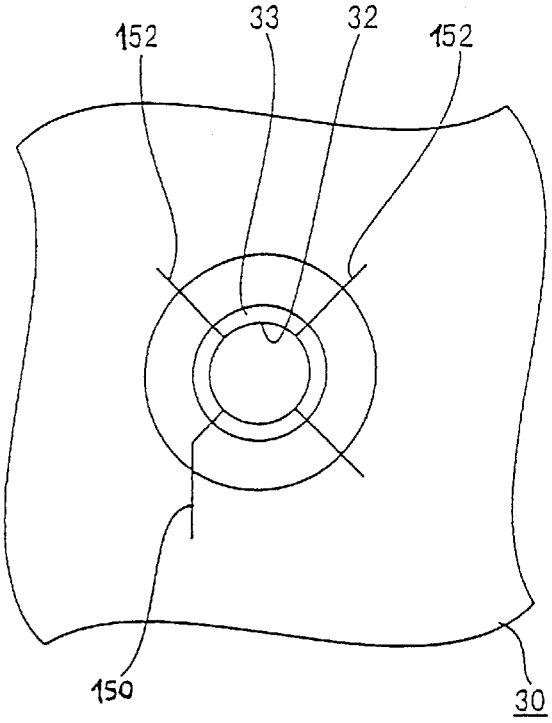
FIG. 18 is a rear view of the waterproof plug.

The wire 28 is introduced into the insertion hole 32 after the passage of the female terminal fitting 23, as shown in FIG. 15. Then, the insertion hole 32, which had been widened by the female terminal fitting 23, elastically narrows and the clearance 151 is closed tightly. As a result, the lips 33 that are formed on the inner surface of the insertion hole 32 are held in sealing contact with the outer surface of the wire 28 over substantially its entire circumference, thereby providing secure sealing around the wire 28.

As described above, the slit 150 is formed in the inner surface of each insertion hole 32 of the waterproof rubber plug 30 to conform to the stabilizer 25 of the connection portion 24 of the female terminal fitting 23. Thus, the stabilizer 25 can pass by forcibly entering the slit 150 during the insertion of the female terminal fitting 23 through the insertion hole 32. This prevents the stabilizer 25 from getting caught and damaging or scratching the inner surface of the insertion hole 32. The female terminal fittings 23 with the stabilizers 25 can be used together with the one-piece type waterproof rubber plug 30. Thus the sealability of the watertight connector is ensured. Furthermore the stabilizers 25 enable the female terminal fittings 23 to be inserted stably into the cavities 11, while the upside-down insertion of the female terminal fittings 23 can be prevented. Further, the slit 150, that had been opened forcibly by the insertion of the female terminal fitting 23, is closed as the insertion hole 32 elastically narrows after the passage of the female terminal fitting 23. The lips 33 then are brought elastically into sealing contact with the outer surface of the wire 28, thereby providing a secure sealing function.

Further, the tapered second guide portion 140 is formed at the entrance end of the insertion hole 32. Consequently, the slanted surfaces 141 of the second guide portion 140 correct the female terminal fitting 14 to a proper orientation even if the female terminal fitting 14 is displaced slightly in a circumferential direction during insertion into the insertion hole 32, and the stabilizer 25 can be slipped securely into the slit 150. Therefore, it is not necessary to pay much attention to the orientation of the female terminal fitting 23 during the insertion, thereby enabling a more efficient inserting operation of the female terminal fitting 23.

Next, still another embodiment of the invention is described with reference to FIGS. 16 to 20. In this embodiment, corner slits for permitting the passage of the corner portions of the female terminal fitting are provided.

The first guide portion 34 is formed with corner slits 152 that extend radially along three oblique sides 36 excluding the bottom right one. The corner slits 152 are formed to have a specified depth and extend up to the front surface of the waterproof rubber plug 30 in substantially the same way as the slit 150.

Figure 19:
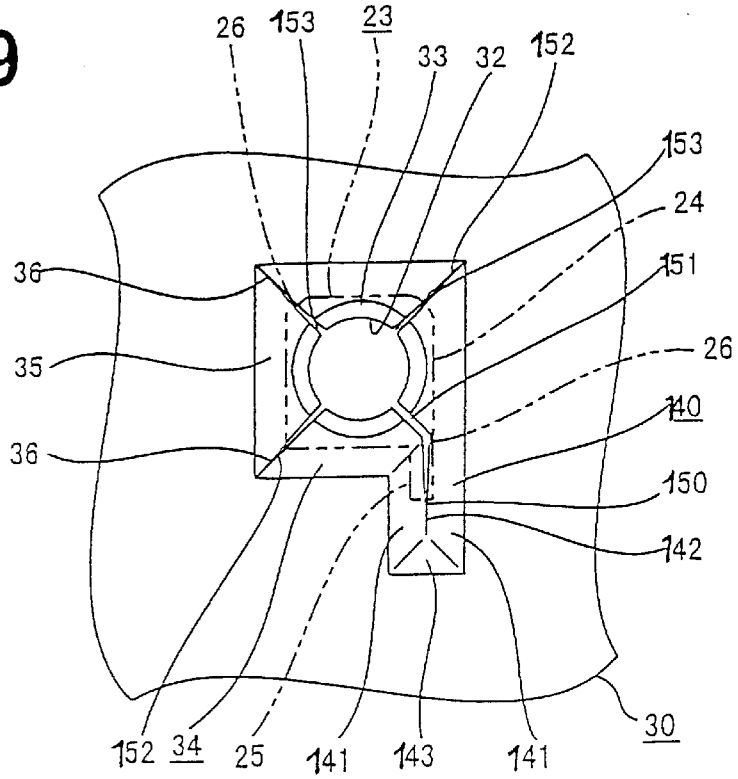
FIG. 19 is a front view showing a state where a connection portion of the female terminal fitting is inserted in an insertion hole.
Figure 20:
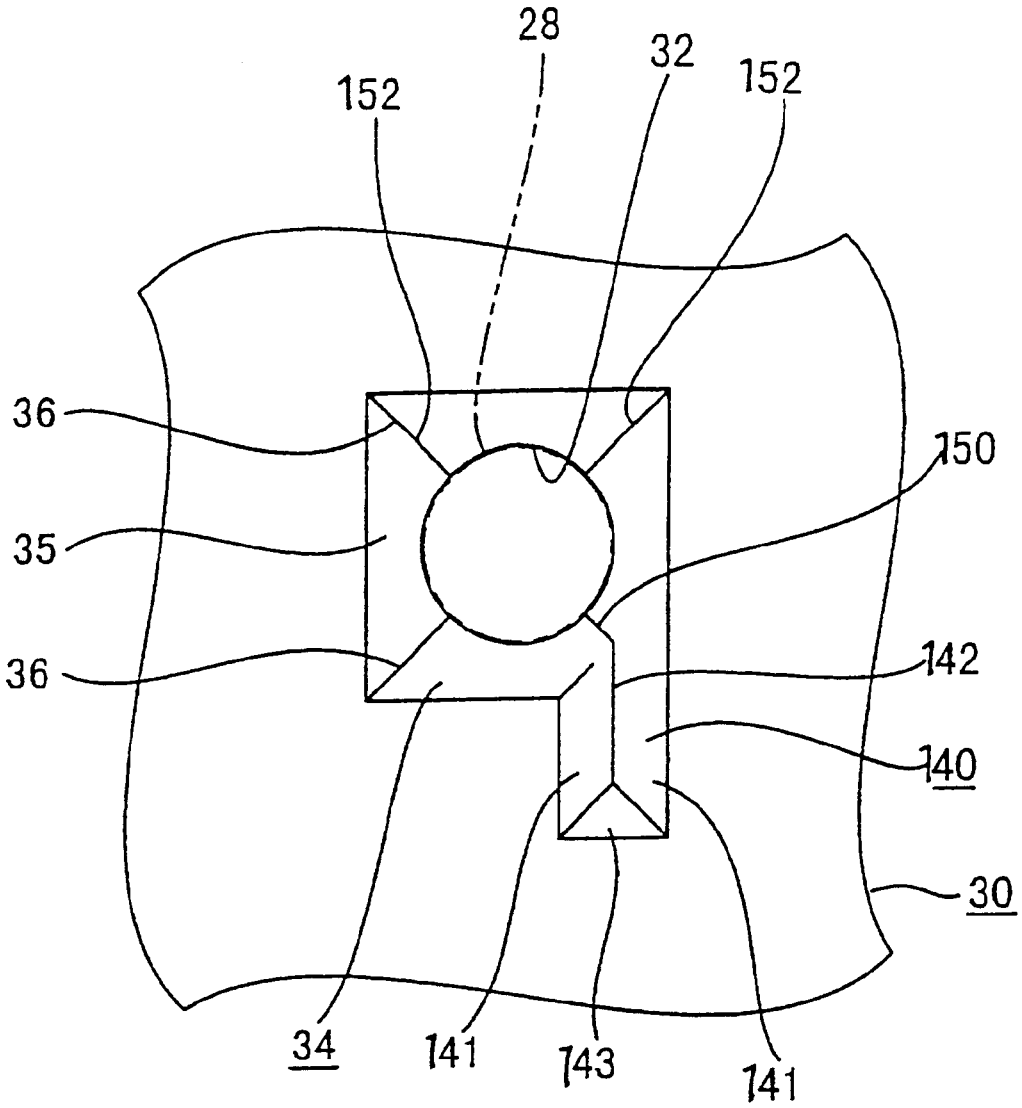
FIG. 20 is a front view showing a state where a wire is inserted in the insertion hole.
Figure 21:
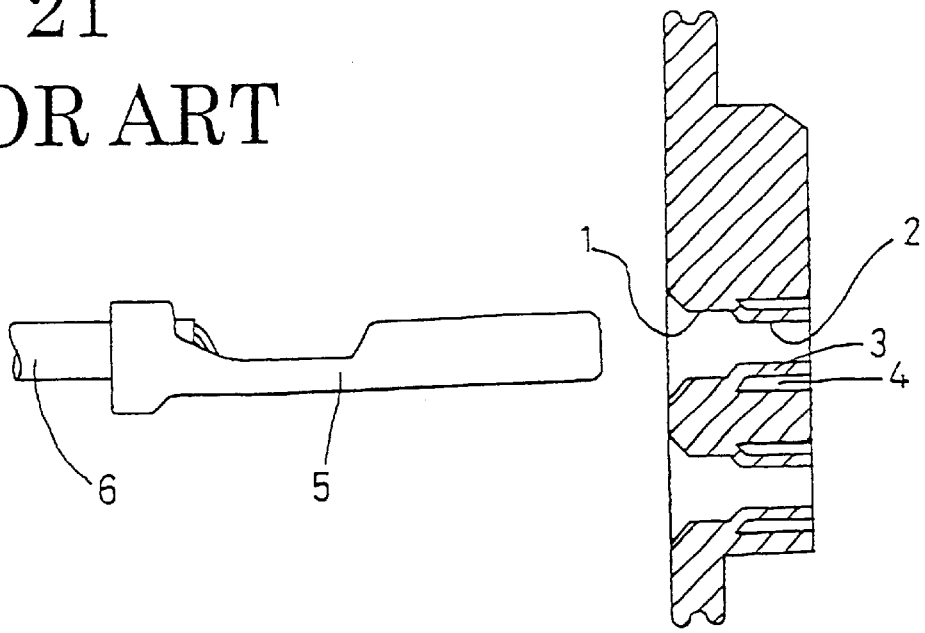
FIG. 21 PRIOR ART
FIG. 21 is a side view partly in section showing a prior art rubber plug.

When the female terminal fitting 23 is inserted into the insertion hole 32, the corner portions 26 of the connection portion 24 are guided toward the oblique sides 36 by the slanted surfaces 35 of the first guide portion 34, and come into contact with the oblique sides 36. When the female terminal fitting 23 is pushed into the insertion hole 32 in this state, the corner portions 26 enter the slit 150 and the corner slits 152, and forcibly open them more widely. The corner portions 26 then pass along clearances 151, 153 formed there, as shown in FIG. 19. Subsequently, the stabilizer 25 forcibly enters the slit 150 and passes along the clearance 150. This prevents the corner portions 26 and the stabilizer 25 from being caught by the lips 33, and damage or tearing of the inner surface of the insertion hole 32 is avoided.

The wire 28 is inserted into the insertion hole 32 after the passage of the female terminal fitting 23. The insertion hole 32, that had been widened by the female terminal fitting 23, then elastically narrows, and the clearances 151, 153 are closed tightly to provide secure sealing around the wire 28.

Other construction, action and effects are not described here to avoid repetition since they are the same as in the previous embodiment.

The present invention is not limited to the foregoing embodiments. For example, embodiments as described below are also embraced by the technical scope of the present invention as defined in the claims. Besides the following embodiments, a variety of changes can be made without departing from the scope and spirit of the present invention as defined in the claims.

It is not necessary to form the guide portions in the insertion holes of the rubber plug provided that the female terminal fittings can be corrected to their proper orientation, for example, by being introduced into the through holes of the pushing member. Rubber plugs having no guide portions are also embraced by the present invention.

The present invention is similarly applicable to rubber plugs into which male terminal fittings having a box-shaped main body are inserted.

Even though the invention has been described with reference to terminal fittings having a substantially box-shaped portion, it is to be understood that the invention can be applied to any type of terminal fitting having a polygonal, round, rounded, elliptical, or other shape.

It is not necessary to form the guide portions in the insertion holes of the rubber plug provided that the female terminal fittings can be corrected to their proper orientation, for example, by being introduced into the through holes of the pushing member. Rubber plugs having, for example, no first guide portions or neither first nor second guide portions are also embraced by the present invention.

What is claimed is:

1. A sealing plug for a watertight connector, into which at least one wire is insertable, said wire having an outer surface and having a terminal fitting secured to its end the terminal fitting having a plurality of corners projecting outwardly beyond the outer surface of the wire, the plug being formed with opposite front and rear surfaces, an outer peripheral surface extending between the front and rear surfaces, at least one insertion hole with an inner surface extending between the front and rear surfaces of the plug, the inner surface of the insertion hole including a cross-sectionally round portion at a location spaced between the front and rear surfaces of the plug, the cross-sectionally round portion being sufficiently engageable with the outer surface of the wire to substantially prevent the intrusion of water, a plurality of slits equal in number to the plurality of corners, the slits being formed in the plug and extending from the inner surface of the insertion hole to a location between the insertion hole and the outer peripheral surface, the slits extending continuously from the front surface of the sealing plug to the rear surface and being formed in positions corresponding to the corners of the terminal fitting, such that portions of the sealing plug adjacent the slits deform to permit passage of the corners of the terminal fitting and resiliently return to an undeformed condition for sealed engagement with the wire.

2. A sealing plug according to claim 1, wherein tapered guide surfaces are formed at an entrance end of the insertion hole for guiding the terminal fitting such that the corners of the terminal fitting are substantially aligned with the slits.

3. A sealing plug according to claim 2, wherein the terminal fitting comprises a substantially planar stabilizer projecting outwardly beyond the wire, at least one said slit being formed in the inner surface of the insertion hole in a position corresponding to the stabilizer of the terminal fitting.

4. A sealing plug according to claim 3, wherein at least one tapered guide surface is formed at an entrance end of the insertion hole for guiding the terminal fitting to a position where the stabilizer thereof is substantially aligned with the slit.

5. A sealing plug according to claim 1, wherein the terminal fitting is substantially box-shaped and has four corners, four radially extending corner slits being formed in the inner surface of the insertion hole in positions corresponding to the corners.

6. A sealing plug according to claim 1, wherein at least one inner lip is provided in an inner portion of the insertion hole to come into close contact with the wire inserted therethrough.

7. A sealing plug according to claim 1, wherein at least one outer lip is provided circumferentially on the outer peripheral surface of the plug to come into contact with a connector housing.

8. A sealing plug according to claim 1, wherein surfaces of said sealing plug defining each said slit are resiliently closed in an undeformed condition of said sealing plug.

9. A sealing plug according to claim 8, wherein at least a portion of each said slit is substantially planar.

10. A sealing plug according to claim 9, wherein each said slit includes a plurality of intersecting planar portions.

11. A sealing plug according to claim 10, wherein a portion of the sealing plug adjacent the rear surface of the sealing plug is non-circular and tapers to said portion of said inner surface of circular cross-section.

12. A watertight connector comprising:

at least one terminal fitting mounted to a wire, the wire having a circular cross-section, at least portions of the terminal fitting defining a non-circular cross-section with a plurality of non-circular portions projecting outwardly beyond the wire;

a connector housing having opposed front and rear ends, the rear end of the connector housing defining a receptacle, at least one cavity extending from the receptacle at the rear end of the connector housing to the front end of the connector housing, the cavity being dimensioned for accommodating the at least one terminal fitting such that the wire projects from the cavity through the receptacle and beyond the rear end of the connector housing;

at least one sealing plug positionable in the receptacle of the connector housing, the sealing plug having a front surface positioned adjacent the cavities, a rear surface positioned adjacent the rear end of the connector housing, an outer peripheral surface engaging portions of the connector housing defining the receptacle and at least one insertion hole extending through the sealing plug from the front surface to the rear surface, the insertion hole being aligned with the cavity and having an inner peripheral surface, at least a portion of the inner peripheral surface being of circular cross-section and dimensioned for sealing engagement with the wire, a plurality of slits extending from the inner peripheral surface of the insertion hole to a location between the inner peripheral surface of the insertion hole and the outer peripheral surface of the plug, the slits being disposed in positions for aligning respectively with the non-circular portions of the terminal fitting, such that portions of the sealing plug adjacent the slits deform to permit passage of the non-circular portions of the terminal fitting and resiliently return to an undeformed condition for sealing engagement with the wire.

13. A watertight connector according to claim 12, wherein the sealing plug is mounted on the connector housing by a mounting member (20).

14. A sealing plug according to claim 12, wherein a portion of the sealing plug adjacent the rear surface of the sealing plug is non-circular and tapers to said portion of said inner surface of circular cross-section.

15. A sealing plug for a watertight electrical connector, said connector having at least one terminal fitting mounted therein, said terminal fitting being secured to a wire, the wire having a substantially round cross-section, and the terminal fitting having a non-round cross-section with a plurality of portions projecting outwardly further than the round cross-section defined by the wire, said sealing plug being formed from a resiliently deformable material and having opposed front and rear faces, an outer peripheral surface extending between the opposed front and rear faces, and an aperture extending between the front and rear faces, the aperture being defined by an inner peripheral surface, the inner peripheral surface having a portion with a circular cross-section dimensioned for sealing against the wire in an undeformed condition of said sealing plug, the sealing plug having a plurality of slits at least equal in number to the projecting portions of the terminal fitting, the slits extending from the inner peripheral surface to a location between the inner peripheral surface and the outer peripheral surface, each said slit extending from the front face to the rear face of the sealing plug and being disposed to align with said portions of the terminal that extend outwardly beyond the round cross-section of the wire, whereby the slits open to enable passage of the terminal fitting through the aperture and resiliently returns to an undeformed condition after passage of said terminal fitting for sealing against said wire.

* * * * *